United States Patent [19]

Lee et al.

[11] 4,090,551

[45] May 23, 1978

[54] MOLD PROTECTION DEVICE FOR THE BOTTOM OF INGOT MOLDS

[75] Inventors: Douglas C. Lee, Pittsburgh; Leonard P. Ziemkiewicz; Victor P. Ardito, both of Lower Burrell; Alex J. Greco, New Kensington, all of Pa.

[73] Assignee: Allegheny Ludlum Industries, Inc., Pittsburgh, Pa.

[21] Appl. No.: 760,203

[22] Filed: Jan. 17, 1977

Related U.S. Application Data

[63] Continuation-in-part of Ser. No. 666,551, Mar. 15, 1976, abandoned.

[51] Int. Cl.[2] ..... B22D 7/06; B22D 41/10

[52] U.S. Cl. ..... 164/137; 249/204

[58] Field of Search ..... 249/174, 204; 29/401 R, 29/401 A, 401 D; 164/137

[56] References Cited

U.S. PATENT DOCUMENTS

| | | | |
|---|---|---|---|
| 1,209,283 | 12/1916 | Gathmann | 249/174 UX |
| 1,223,775 | 4/1917 | Dornin | 249/174 UX |
| 1,419,454 | 6/1922 | Gathmann | 249/174 UX |
| 1,819,705 | 8/1931 | Gathmann | 249/174 |
| 1,915,729 | 6/1933 | Gathmann | 249/204 X |
| 2,054,597 | 9/1936 | Gathmann | 249/174 UX |
| 2,231,774 | 2/1941 | Rigdon | 249/204 |
| 2,444,140 | 6/1948 | Messler | 249/204 |
| 2,878,538 | 3/1959 | Theis | 249/206 |
| 3,146,504 | 9/1964 | Mellott | 249/204 |
| 3,682,435 | 8/1972 | Lofberg | 249/174 X |

*Primary Examiner*—Francis S. Husar
*Assistant Examiner*—John S. Brown
*Attorney, Agent, or Firm*—Vincent G. Gioia; Robert F. Dropkin

[57] ABSTRACT

A ceramic refractory mold protection device for an ingot mold having a flat top surface with a hole therethrough includes a shank portion which fits in the hole an integral head portion which is adapted to rest on the flat top surface and cover the impact area onto which steel is teemed. The head portion extends between 1 and 3 inches from the shank and is between ¾ and 2 inches high. After the steel is poured and the ingot stripped from the mold, the protective device is removed from the mold and replaced by a new one for the next pour.

10 Claims, 10 Drawing Figures

MOLD PROTECTION DEVICE FOR THE BOTTOM OF INGOT MOLDS

FIELD OF THE INVENTION

This application which is continuation in-part of our copending application Ser. No. 666,551 filed Mar. 15, 1976 and now abandoned relates to a mold protective device and more particularly to a ceramic refractory device which both closes and protects the opening through the bottom of closed plug bottom BEU (big end up) ingot molds and the stool for open BED (big end down) ingot molds.

DESCRIPTION OF THE PRIOR ART

BEU molds are usually provided with an opening at the bottom in order to assist in the removal of the ingot mold. BED molds are usually open on the bottom and rest on the stool, and in some instances chill pads have been placed onto the stool.

One of the difficulties with BEU large size molds is that the mode of failure is usually localized at the mold plug hole area. Such failure is caused by the teeming stream impact. These molds are usually scrapped after about 10 to 15 pours because of damage to the bottom as a result of the teeming which erodes the bottom and results in insufficient bottom thickness in the plug hole area. As the bottom erodes, the plug hole becomes enlarged and substantial leaking during teeming takes place, but the remainder of the mold which includes the side walls is in an excellent condition. In the past, washes and chill pads have been used, but these also were not effective to extend the life of the mold appreciably.

Conventional mold plugs have been used since the inception of the use of closed bottoms molds. The conventional mold plug usually rests flush with the mold bottom or in some instances is recessed slightly below the mold bottom.

The closed bottom BEU ingot molds are used extensively in the steel industry and are manufactured with a tapered plug hole in the center of the bottom surface. Before an ingot is teemed, a ceramic plug which is shaped to the same contour as the plug hole is inserted into the hole at the bottom of the ingot mold. The purpose of this hole-plug assembly is to provide for an access for the application of a pushing force by means of a plunger particularly in that situation when the mold and the ingot are turned upside down and the ingot does not separate itself or does not lend itself readily to stripping from the ingot mold.

During the pouring of the ingot, liquid steel drops initially from the bottom of the ladle to the bottom of the mold. This distance varies with the size of the mold, but is normally between 9 and 12 feet. The initial force of the hot liquid steel impinging onto the mold bottom severely erodes the bottom and specifically erodes the top edge or perimeter of the plug hole. After repeated use, the erosion of the top of the plug hole, and the mold bottom in general is so extensive that the mold must be scrapped even though the sidewalls are virtually free of wear.

Moreover, when the steel is poured into a BEU mold, a huge cavity usually wears around the opening for the mold plug. During the teeming, the metal hits the corners of the opening for the mold plug and burns the edges off from the opening surrounding the mold plug. In certain instances, the opening for the mold plug becomes so large that the mold plug does not cover the opening entirely and the bottom of the mold leaks and some of the value of the metal is lost. In addition, as the plug hole opening becomes enlarged, improper sealing of the mold plug results. Where some of the value of the metal is lost there is of course a poor yield in the ingot stage and blooming mill. With BEU large size molds, the mode of failure is usually localized at the mold plug hole area which is caused by the stream impact during teeming. These molds are then usually scrapped because of insufficient bottom thickness in the plug hole area to prevent substantial leaking during teeming, but the remainder of the mold is in excellent condition.

When a BED mold is employed, a stool is used, and these stools also wear out very rapidly. In the past, when a teeming stream impact pad was used, numerous problems arose because these pads were expensive and they had to be the same material as the steel being poured. Quality problems also arose as a result of dissimilar metals. The yield was also decreased.

It should also be noted that the molds are usually made by one manufacturer and another manufacturer makes the conventional plugs, and in some instances the tolerances of the mold plug opening and the mold plugs are such that the mold plug does not have a perfect fit with the plug hole and the ingot mold will leak.

In the pouring of steel into a BED mold, the bottom of the mold is conventionally open and a stool is used to provide for the bottom closure. When stools are used, it has been known to use a chill mat or similar device to protect the stool, but these have not been too satisfactory as they cannot be held in place. The chill mats are known to move around during the teeming and they do not protect the stool. In addition, when the BED mold with a completed ingot is removed from the stool, the stool is damaged as a result of the ingot pulling away from the stool. Therefore, with BED molds, the stool may be damaged both as a result of the teeming of the steel and as a result of the pulling away of the ingot.

SUMMARY OF THE INVENTION

It is an object of the invention to overcome the aforesaid difficulties and to provide a BEU mold in which the life of the bottom thereof is extended.

A further object of the invention is to provide a device to extend the life of the BEU molds so that the base will last as long as the sides of the mold.

Yet another object of the invention is to provide a BED mold in which the life of the stool is extended.

Accordingly, it is a further object of the invention to extend the life of the bottom area of an ingot mold in general with particular emphasis to the area in the vicinity of the center of the mold onto which the teeming stream impacts.

Where it has become possible to eliminate the "leakers," it is possible to eliminate those ingots which have a poor yield in the ingot stage and blooming mill.

Accordingly, the present invention proposes the use of a novel mold protection device which includes a shank portion and a head portion. The shank portion normally fits within a receiving portion, such as an opening or recessed portion in the bottom of the mold, and the head portion covers the top of the receiving portion and provides for a base for the impingement of the teemed steel. The teemed steel now hits the plug head and does not damage the bottom of the mold base.

When the mold protection device is used in connection with a BEU mold, the mold protection device includes a mold plug having a shank which fits within the normal conventional through opening in the bottom and a head portion which overlies the opening and insulates the edges of the opening from the teemed steel.

When the mold protection device is used for a BED mold, the mold protection device includes a plug-type member having a shank portion and a head portion. The stool is provided with a recessed portion or area for receiving the shank of the mold plug, and the head provides for a protective area for a portion of the stool face which is normally in contact with the ingot as well as the base onto which the steel is teemed.

It has also been found that when the plug for the BEU molds in accordance with the invention is used, the mold life is increased to from 40 to 50 pours or uses. With the mold plug in accordance with the invention, it has been found that the sidewalls of the mold is generally the first to fail rather than the bottom. When considering that a mold costs about $6,000, it will be evident that the increased life of the mold from 10 pours to at least 40 pours materially reduces the costs involved for molds. The cost of the plug is minor, and moreover, the plug is a disposable item. Moreover, with the BED molds as set forth heretofore, when the ingot is removed from the stool, a portion of the top face of the stool has a tendency to be removed and the stool becomes damaged after a number of uses. When the mold protection device is used on the top face of the stool, any damage which occurs will occur to the mold plug and thereby the life of the stool is increased. Moreover, the mold plug may be removed each time after each use, if necessary, and a new plug can be easily reinserted so that the stool face is as good as new at a minimum of cost. Mold washes are conventional, and they are used to protect the mold. The conventional mold washes may also be used with the novel plug in accordance with the invention.

With the present invention, even where the shank portion of the plug member and the openings or recessed area to receive the shank portion are not perfectly aligned, the head portion which serves to protect the base or bottom will remain in position. In addition, a ceramic cement may be used to further hold the shank portion in place. As noted, the plugs are sufficiently inexpensive so that there is no cost problem in connection with the replacement of the plug members, and the sidewalls now become the first element to fail. Moreover, the replacement of the mold protection devices are relatively easy when used with the stool. All that may be necessary is to chip or clean them out. With BEU molds, they are usually removed after each use and replaced.

Other objects and advantages of the invention will become apparent from the detailed description of the invention.

BRIEF DESCRIPTION OF THE DRAWINGS

In the accompanying drawings which shows the preferred embodiments of the invention, the same reference characters will be used throughout to indicate similar elements.

Figure 1:
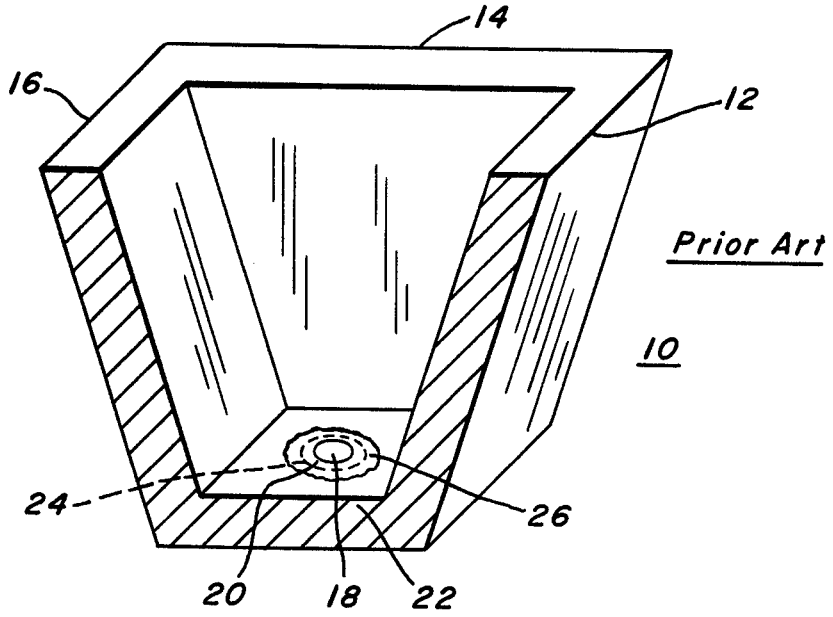
FIG. 1 is a BEU mold with one sidewall removed using a conventional mold plug.
Figure 2:
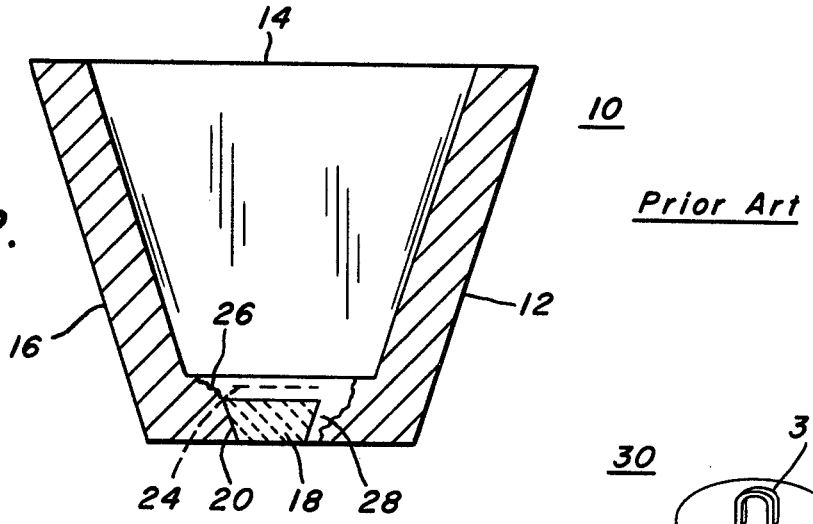
FIG. 2 is a vertical section through a BEU mold using a conventional mold plug which has become recessed because the plug hole opening has become enlarged.

Referring now more particularly to FIGS. 1 and 2 of the drawings, the conventional BEU mold 10 is shown with the three sidewalls 12, 14 and 16 and with the front sidewall removed. A conventional plug 18 is shown inserted within the plug hole opening 20 in base 22 of the ingot mold. The plug 18 is shown recessed within the plug hole opening 20 with the top of the plug 18 below the top of the base 22. Dotted outline 24 indicates the original opening edge of plug hole opening 20 when the ingot mold was new and prior to use. Area 26 indicates the portion of the bottom of the mold which has been eaten away as a result of repeated teeming operations. As more and more of the base area is eaten away, the bottom becomes so thin that it is either unusable or starts to leak because of an improper fit between the plug 18 and opening 20. The space 28 between the plug 18 and the wall of the opening 20 permits leakage. This results in a leaking down and loss of value of metal which in turn provides for a poor yield in the ingot stage or blooming mill.

The top of a conventional plug normally rests flush or slightly recessed with the inside surface of the mold bottom. Normally, the thin cross section at which the inside bottom surface of the mold and the side of the plug hole meet is extremely vulnerable to wear by impact of the falling stream of hot steel during teeming. In normal practice, after several pours into a particular mold, erosion which started at the edge of the plug hole quickly can spread outward toward the mold walls in all directions, as noted by area 26. The normal opening 24 is shown in dotted outline and has been exaggerated to show the spread of the wear to the portion 26. As the portion 26 becomes thinner and thinner, the mold base 22 becomes such that it is not useable and furthermore, a leak through the space 28 as noted above may occur, and further, the opening 20 may become so enlarged, that a plug cannot remain or be held within the plug hole.

Figure 3:
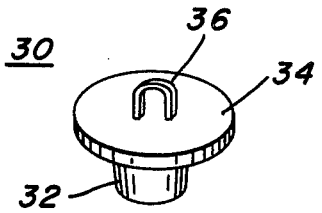
FIG. 3 is a perspective view of a mold protection device in accordance with the invention.
Figure 4:
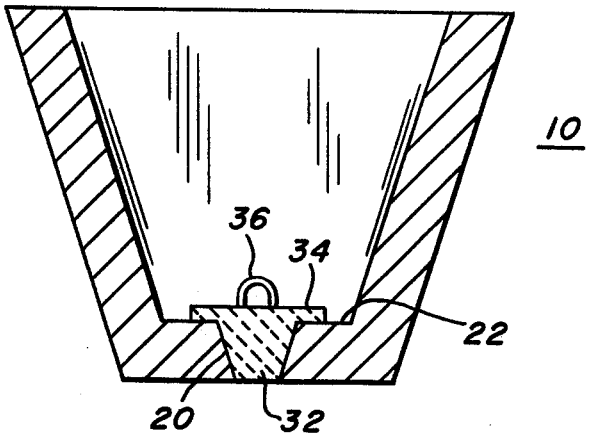
FIG. 4 is a conventional BEU mold using the mold protection device of FIG. 3.

Referring now more particularly to FIGS. 3 and 4, the mold protection device includes a plug 30 having a shank portion 32 and a head portion 34 integrally connected thereto. The plug may also include a hook 36 which can be used to appropriately place it into the plug hole opening 20 in base 22 of the conventional BEU mold 10.

The plug 30 in accordance with the invention is tapered along its shank portion 32 so as to fit within the complementary tapered opening 20 of the plug hole, and the head portion 34 rests on the base portion 22. If the plug hole opening 20 is not the exact same size as the shank 32, the head portion 34 will cover the opening 20. This provides for wider tolerances and variations between mold plug hole openings and the protection devices in accordance with the invention and yet insure that there is no leakage. It will be seen that the mold bottom has a substantially flat top surface and that the head portion has a substantially flat bottom surface resting on the flat top surface of the mold bottom and a continous generally flat upper surface over substantially the full height thereof. If the top surface is grooved rather than flat the plug will be less efficient and will tend to break up. We have found that the plug must extend outwardly from the shank portion a distance of between about 1 and 3 inches so as to overlap the opening 20 and to be in the direct area of the teeming stream so that the teeming stream will not damage the base 22. If the overlap is more than 3 inches the yield is reduced and there is danger that the plug will break prematurely. We have also found that the head portion 34 must have a height between about ¾ and 2 inches. Variations from these dimensions results in premature break up of the plug or reduction in yield and/or quality at the bottom of the ingot. If the opening 20 is quite oversized, it will be evident that the head portion 34 will be sufficient to cover the same so that ingot molds which were initially poorly made with large or non-usuable oversized plug hole openings can now be used. Moreover, to assist in the firm sealing of the plug with respect to the mold bottom a ceramic cement may also be used between the shank portion 32 and the sides of the opening 20. The plug 30 is made of a ceramic refractory material. One composition found desirable is an alumina-silicon oxide castable refractory which may contain approximately 40% alumina, 50% silicon oxide and a suitable binder. It is preferred to cast the plug and cure it a temperature of about 700° F. In some instances steel wire mesh or chopped (short pieces) of steel wire have been used.

With regard to the portion 26 it will be evident that a huge cavity wears around the edges of the plug hole opening as a result of the teemed metal hitting the corner of the plug hole opening and burning the edges off.

The mold plug is generally T-shaped, and the tip of the T or head section 34 provides the direct protection for the end and edges of the plug hole itself. As noted heretofore, the top of a conventional plug rests flush or slightly recessed within the inside surface of the opening 20 in the mold bottom; and the thin cross section where the inside bottom surface of the mold and the side of the plug hole meet is extremely vulnerable to wear by impact of the falling stream of hot steel. With the plug 30 in accordance with the invention, the most vulnerable portion of the bottom of the mold is directly protected from the impact of a falling metal stream during teeming.

Figure 5:
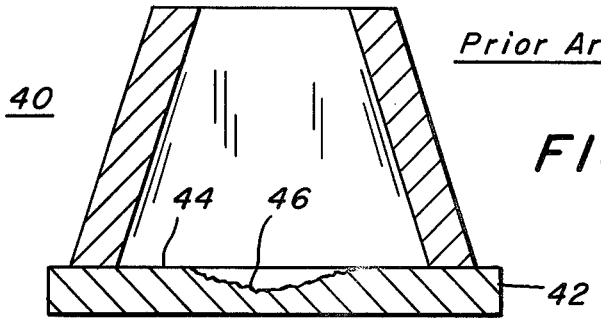
FIG. 5 is a vertical section through a conventional BED mold with a conventional stool.

Referring now to FIG. 5, a BED mold 40 is shown seated on a conventional stool 42. The base or top face 44 of the stool 42 is shown with a portion 46 removed or damaged as a result of the tearing away of the ingot from the face or top surface of the stool when the ingot mold is removed from the stool 42.

Figure 6:
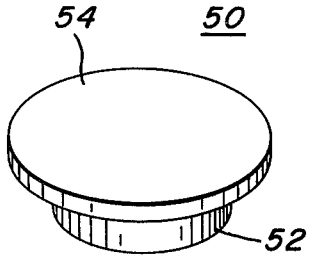
FIG. 6 is a perspective view of another mold protection device in accordance with the invention.

Referring to FIG. 6, another embodiment of a mold protection device 50 is shown for use with the BED mold of FIG. 5 having a shank portion 52 and a head portion 54. The BED mold 40 used in conjunction with a stool 56 has the mold protection device 50 associated therewith. The stool 56 is provided with a recessed area or portion 58 adapted to receive and hold the shank portion 52 with the head portion 54 seated on the top surface 60 of the stool 56. To provide a better gripping action or holding action between the shank portion 52 and the recessed area 58, a ceramic cement may desirably be used. (FIG. 7).

Figure 7:
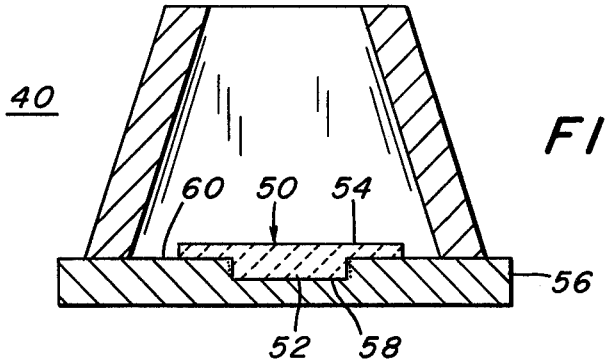
FIG. 7 is a vertical section through a conventional BED mold with the mold protection device of FIG. 6 used with the stool.

In the FIG. 7 embodiment it will be obvious that the opening of the recessed area 58 may be made larger than the diameter of the stem or shank portion 52 and the head 54 will still remain within the area of teeming or pouring of the molten steel.

Figure 8:
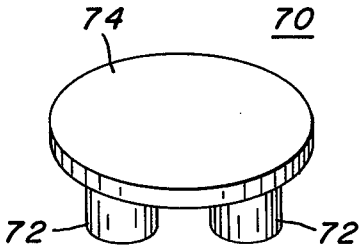
FIG. 8 is a modification of the mold protection device of FIG. 6.
Figure 9:
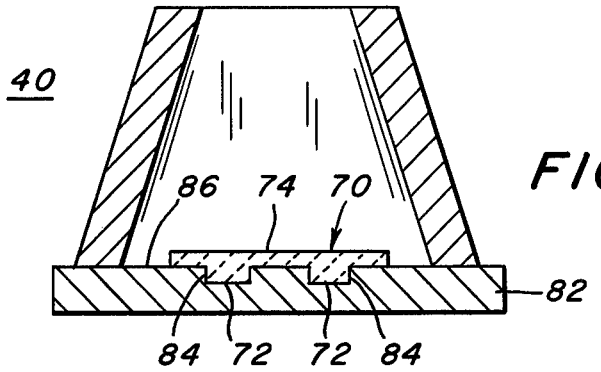
FIG. 9 is a vertical sectional view of a BED mold in which the mold protection device of FIG. 8 is used with the stool; and, FIG. 10 shows a conventional BEU mold with the mold protection device of FIG. 3 used with a ceramic fiber washer.

Referring now more particularly to FIG. 8 which shows another modification of a mold protection device 70 according to the invention for use with the BED mold 40, the device 70 includes a pair of shank portions 72 and a head portion 74. FIG. 9 shows a BED mold 40 seated on a stool 82 provided with a pair of recessed portions or areas 84 adapted to receive the pair of shank or stem portions 72 to seat the head portion 74 onto the surface 86 of the stool 82. Shank portions or legs 72 fit within the recessed portions 84 which have a diameter greater than the diameter of legs 72. This will afford ease of placement of the mold protection device or plug 70 onto the stool as well as permit the proper positioning of the mold plug 70 on the face 86 of stool 82.

With the mold plugs or protection devices 50 and 70, the life of the stool is extended for a considerable number of pours because the edge portions 48 of the area 46 as well as the area 46 itself are not damaged by the teeming of the molten steel during the teeming operation.

Figure 10:
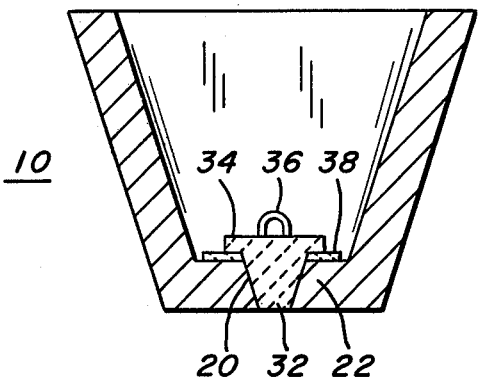

If for some reason the area of the BEU mold bottom (FIG. 4) between the edges of the mold plug head 34 and the sides 12, 14 and 16 of the mold are damaged, it is possible to employ a ceramic fiber washer 38 (see FIG. 10) between the mold plug head 34 and the base 22 and thereby extend the life of the ingot molds still further. The washer 38 is provided with an opening which is adapted to receive the shank portion 32 and is in registry with the opening 20 in the mold bottom 22. The head portion 34 rests on the washer which is positioned between the head portion 34 and the base 22. The shape of the special mold plug 30 allows it to act as an anchoring device for a ceramic fiber washer 38 which otherwise might tend to float and thereby lose its effectiveness in protecting the mold bottom.

It will also be noted that the plug head does not provide for a large overlap and is not equivalent to the chill mats heretofore used which did not increase mold life. Moreover, when the chill mats or chill plate was used with the stool in BED molds they moved and were not effective to prevent the chewing out of the top surface of the stool in the impact area. The mold protection device in accordance with the invention will generally remain in place because of its positioning and registry with the openings in the stool, and as noted heretofore, a ceramic cement can be used to assure proper retention.

While there has been shown what is considered to be the preferred embodiments of the invention, it will be obvious to those skilled in the art that various changes and modifications may be made without departing from the spirit and scope of the invention.

We claim:

1. The combination of an ingot mold having a bottom with a generally vertical opening therein and a substantially flat top surface surrounding said opening, sidewalls extending upwardly from said flat top surface free of projecting corners and an opening at the top of said sidewalls through which molten metal is poured into said mold; and a ceramic refractory mold protection device comprising a shank portion having a contour adapted to be received within said vertical opening, and a head portion integrally connected to said shank portion, said head portion having a substantially flat bottom surface extending outwardly from said shank portion a distance of between about 1 and 3 inches and adapted to contact only a portion of said top surface and a continuous generally flat upper surface over substantially the full extent of said shank portion and said flat bottom surface, said head portion having a height of between about ¾ and 2 inches throughout.

2. The combination of claim 1 in which said mold is a big end up mold and said opening extends through said bottom, said shank portion fitting within said opening, and said head portion extending over and covering said mold plug opening.

3. The combination of claim 2 wherein said opening is tapered, and said shank portion has a taper conforming to the opening.

4. The combination of claim 2 including a ceramic fiber washer having an opening therethrough, said washer being placed onto said bottom of said mold with said shank portion passing through said washer opening and said head portion resting on said washer.

5. The combination of claim 1 in which said mold is a big end down mold and is supported by a stool, said stool forms said bottom of said mold, said receiving portion includes a recessed area, said shank portion fits within said recessed area, and said head portion extends over and covers said recessed area.

6. The combination of claim 5 in which the diameter of said recessed area is larger than the diameter of said shank portion, and said device includes a ceramic cement on said shank portion to hold said shank portion in said recessed area to maintain said head portion onto said stool in contact with said surface onto which said teeming stream impacts.

7. The combination of claim 1 in which said mold is a bid end down mold and is supported on a stool, said stool forming said bottom of said mold, said receiving portion includes a prior of recessed areas, said shank portion includes a pair of stems, one for each said recessed areas, said stems fit within said recessed areas, and said head portion extends over both said stem portions and covers both said recessed areas.

8. The combination of claim 7 in which said stem portions are cemented to said recessed areas and are held thereto in unitary engagement therewith.

9. The combination of claim 1 in which said device is a casting having wire reinforcing wires therein.

10. The method of pouring steel into an ingot mold having a bottom with a generally vertical opening therein and a substantially flat top surface surrounding said opening, and sidewalls extending upwardly from said flat top surface free of projecting corners; which comprises providing a ceramic refractory mold protection device including a shank portion and a flat head portion integral therewith extending outwardly therefrom a distance of between 1 and 3 inches and having a height of between ¾ and 2 inches, placing said mold protection device in said mold with its shank portion in said hole closing the same and its head portion resting on the top of said substantially flat top surface of said mold bottom and said head portion contacting a portion of said top surface, then pouring steel into said mold on top of said head portion, then stripping said ingot from said mold to obtain an ingot having the periphery of its bottom substantially flat, and removing said protective device from said mold.

* * * * *